US005201843A

United States Patent [19]

Hair

[11] Patent Number: 5,201,843

[45] Date of Patent: Apr. 13, 1993

[54] INTERLOCKING PAVING STONE FOR OPEN DRAINAGE GROUND COVER PATTERN

[76] Inventor: Roberta A. Hair, 7554 Wooster Rd., Cincinnati, Ohio 45227

[21] Appl. No.: 834,127

[22] Filed: Feb. 11, 1992

[51] Int. Cl.[5] ..... E01C 5/00

[52] U.S. Cl. ..... 404/41; 404/42

[58] Field of Search ..... 404/34, 41, 42; 52/311

[56] References Cited

U.S. PATENT DOCUMENTS

| | | | |
|---|---|---|---|
| D. 102,145 | 1/1936 | Parker . | |
| 572,762 | 12/1896 | Landers . | |
| 962,150 | 6/1910 | Jennison . | |
| 1,379,440 | 5/1921 | Brainerd . | |
| 1,460,516 | 7/1923 | Sheen . | |
| 2,210,150 | 8/1940 | Notari . | |
| 3,759,043 | 9/1973 | Tokunaga . | |
| 3,903,702 | 9/1975 | Appleton . | |
| 3,953,009 | 4/1976 | Kan . | |
| 4,052,131 | 10/1977 | Kowrigkeit . | |
| 4,128,357 | 12/1978 | Barth et al. . | |
| 4,544,305 | 10/1985 | Hair . | |
| 4,773,790 | 9/1988 | Hagenah . | |
| 4,781,492 | 11/1988 | Shindo . | |
| 4,834,575 | 5/1989 | Barth et al. . | |
| 4,919,565 | 4/1990 | Göpfert . | |
| 4,973,192 | 11/1990 | Hair . | |
| 4,997,308 | 3/1991 | Welling, Jr. . | |
| 5,054,957 | 10/1991 | Johnson, II . | |
| 5,108,219 | 4/1992 | Hair | 404/42 X |

FOREIGN PATENT DOCUMENTS

| | | | |
|---|---|---|---|
| 630067 | 7/1963 | Belgium . | |
| 1119315 | 12/1961 | Fed. Rep. of Germany . | |
| 2407621 | 8/1975 | Fed. Rep. of Germany | 404/42 |
| 7920065 | 2/1980 | Fed. Rep. of Germany . | |
| 2841261 | 4/1980 | Fed. Rep. of Germany . | |
| 3303210 | 8/1984 | Fed. Rep. of Germany . | |
| 6806306 | 11/1968 | Netherlands . | |
| 197711 | 11/1977 | Switzerland . | |
| 552303 | 3/1943 | United Kingdom . | |

OTHER PUBLICATIONS

Uni-Group U.S.A. Brochure, "Uni Eco-Stone", 1991.

*Primary Examiner*—William P. Neuder

*Attorney, Agent, or Firm*—Wood, Herron & Evans

[57] ABSTRACT

A paving stone that can be laid in one or more open patterns, permitting water to drain through areas in the formed ground cover, is provided. The stone has six interlocking multifaced side surfaces, three on a concave part of the stone and three on a convex part of the stone, that interlock with complimentary side surfaces of adjacent stones, and has eight corner side surfaces that bound and define the shape of drainage areas. Each of the drainage areas is surrounded by identical interlocking stones. In the preferred embodiment, the multifaced surfaces of each of the parts are identical so that the stones can be laid interchangeably at any place in a runner bond or herringbone pattern. The faces of the multifaced side surfaces of the stones are preferably planar and form V-shaped interlocking surfaces.

20 Claims, 3 Drawing Sheets

INTERLOCKING PAVING STONE FOR OPEN DRAINAGE GROUND COVER PATTERN

The present invention relates to paving stone slab elements for covering horizontal areas such as the ground and, more particularly, to paving stones of the interlocking type that provide an open drainage ground cover.

BACKGROUND OF THE INVENTION

Paving stones of the type to which the present invention relates are manufactured slab elements usually molded of ceramic material, most commonly concrete, into predetermined shapes which, when arranged in a pattern, form a covering for the ground or other surface area which is generally intended to bear pedestrian or vehicular traffic.

Bricks, cut stones and slab elements of various types have been used in the past to cover roads and walkways to form a pavement or ground cover arrangement. In forming the ground cover pattern, the elements are often laid adjacent each other in an array to cover the area being paved. The most common shape of element used historically is the rectangular brick like shape which can easily be arranged to cover the ground without resort to combinations of stones of different sizes or shapes to do so. Such elements are laid with or without grout or mortar joints which rigidly join one element with another.

A type of ground cover finding increasing use is that formed of the paving stones laid without mortar or grout, usually with joints filled with particulate material such as sand. The advantages which such ground covers present are an ability to tolerate movement and deformation without exhibiting the cracking and breaking which may result with ground covers in which rigid grout or mortar joints are employed.

An example of a disadvantage found with some paving stones of the prior art, as for example the simple rectangular elements such as bricks and rectangular stones, is that, when used with sand or other loose fill joint material, surface water flowing on the pavement area formed of such a ground cover has a tendency to erode or wash the joint material from between the elements. A further example of a disadvantage of many such elements is that they have a tendency to tilt or yield under locally heavy loads.

One solution to both the problem of the washing of joint material from between the elements and to the problem of movement under load has been the introduction of mortarless or groutless paving stones of the interlocking type. Such interlocking paving stones are for example those disclosed in the Hair U.S. Pat. Nos. 4,544,305 and 4,973,192 and of Barth et al. Nos. 4,128,357.

An objective in the design of interlocking paving stones, as seen in the Hair and Barth patents, is the creation of shapes which will interlock in such a way as to cover the area being paved with a minimum of different stone shapes. It is highly desirable that stones of a single size and shape be capable of forming an interlocking pattern which covers the ground without the need for filler stones of different shapes. Such a characteristic reduces the number of costly molds and the need for distributors and installers to maintain inventories of different stones.

One disadvantage of most of the paving stones of the prior art, when laid without mortar or grout filling the joints, is that the drainage area between adjacent stones is narrow, typically ⅜ or less, the width of a typical mortar joint. This closeness is necessary to that the adjacent faces of adjacent stones provide structural support to each other, to hold the stones in place and level. However, for certain applications, such spacing is inadequate to provide the necessary drainage that the site requires. While it is possible to lay many stones of the prior art with open spaces present in the patterns to allow additional drainage, many of such stones do not at the same time interlock, and thus form a ground cover that is less effective in resisting distortion and breakage with heavy loads.

Other stones of the prior art are provided with shapes to facilitate drainage. An example is the stone described in the Welling U.S. Pat. No. 4,997,308. Such a stone does not, however, have interlocking capabilities.

A desirable feature of paving stones is an ability to be laid in a herringbone pattern. The herringbone pattern, with its crossing stone orientations, provides a stronger ground cover, more effective interlock between stones, and better resists erosion of the loose material from between the stones. Many stones of the prior art, such as the stone of Welling, discussed above, do not lend themselves to arrangement in a herringbone pattern.

It has also been an objective, difficult in many cases to achieve, to shape the stones in a way that they will not only satisfactorily interlock and form a pattern which covers the area being paved, but which will do so with shapes which present boundaries which contribute to a particular aesthetic pattern. By the very nature of the stones, the boundaries that define their shapes make the primary contribution to the overall appearance of the patterns. Unfortunately, not all aesthetically desirable shapes are easily made to interlock effectively. The desire to provide certain shapes in paving stones makes it difficult to design stones which interlock effectively. Thus, the desire to form patterns which yield certain aesthetic effects imposes a constraint on the stone characteristics which preclude the utilitarian properties for which the interlocking stones are desired.

In addition, many paving stones of the prior art have, when attempting to achieve the aesthetic and interlocking pattern forming objectives, failed to produce a stone that is capable of bearing heavy loads and resisting breakage.

Accordingly, there has existed a need for an interlocking paving stone with sides angled and shaped to cover the ground with stones of a single size and shape, which are sufficiently strong to gear heavy loads, which can be laid to provide adequate drainage for the requirements of the site, and which can be laid in open patterns, and particularly open patterns including a herring bone pattern, to provide drainage area, and which can do so with a stone of a single shape.

SUMMARY OF THE INVENTION

It is a primary objective of the present invention to provide a paving stone having a shape defined by sides and angles of its upper and lower surfaces to enable it to form a ground cover that presents open areas for drainage. It is a more particular objective of the present invention to provide a paving stone of a single shape and size, that is capable of to forms interlocking patterns with other identical stones, and forms an open pattern or a plurality of open patterns, particularly a herring bone pattern, that provides areas for drainage.

According to the principles of the present invention, there is provided a paving stone having a plurality of multifaced side surfaces that can be interlocked with side surfaces of adjacent stones to form one or more ground cover patterns, including herringbone and runner bond patterns.

The interlocking paving stone of the preferred and illustrated embodiments of the present invention that is capable of being laid in an open pattern is formed of an integral block of molded ceramic material having a generally horizontal upper surface, a generally identical and generally parallel lower surface spaced from the upper surface a distance defining the thickness of the stone, six generally vertical multifaced interlocking side surfaces, and eight generally vertical corner surfaces. Each of the horizontal surfaces is a two portion horizontal surface defined by a first and preferably convex portion and a second and preferably concave portion. Each of these portions has eight sides, one which the two portions share in common, and alternating corner sides and multisegment sides, forming a stone bounded by fourteen generally vertical single or multifaced side surfaces.

To form at least one of the patterns, at least one of the multisegment sides of the first portion is complementary to at least one of the multisegment sides of the second portion such that, when a plurality of stones are arranged in a pattern, a surface corresponding to the multisegment side of the first portion of a first stone interlock with a surface corresponding to a multisegment side of the second portion of an adjacent stone, and drainage areas are produced adjacent each stone of the pattern.

In order to be capable of being laid in a runner bond pattern, the end sides of each portion of the stone are complementary, and each of the lateral sides of the first portion are complementary to a different one of the lateral sides of the second portion, such that, when a plurality of stones are arranged in a runner bond pattern, the surface corresponding to the end side of the first portion of a first stone interlocks with the surface corresponding to the end side of the second portion of a second stone, while the surfaces corresponding to the lateral sides of the first portion of the first stone each interlock with a surface corresponding to a lateral side of the second portion of respective second and third stones, and drainage areas, each surrounded by interlocking stones, are produced adjacent each stone of the pattern.

To be capable of being laid in an open straight runner bond pattern, the first and second lateral sides of the first portion are complementary to a respective first and second lateral sides of the second portion, such that, when a plurality of stones are arranged in a straight runner bond pattern, the surfaces corresponding to the first and second lateral sides of the first portion of the first stone each interlock with the surfaces corresponding to respective first and second lateral sides of the second portion of respective second and third stones. To be capable of being laid in an open reverse runner bond pattern, the first and second lateral sides of the first portion are complementary to a respective second and first lateral sides of the second portion, such that, when a plurality of stones are arranged in a reverse runner bond pattern, the surfaces corresponding to the first and second lateral sides of the first portion of the first stone each interlock with the surfaces corresponding to respective second and first lateral sides of the second portion of respective second and third stones.

To be capable of being laid in either a straight runner bond pattern or a reverse runner bond pattern, the lateral sides of the first portion are each complementary to lateral sides of the second portion, such that, when a plurality of stones are arranged in either a straight runner bond pattern or a reverse runner bond pattern, the surfaces corresponding to the lateral sides of the first portion of the first stone each interlock with a surface corresponding to a lateral side of the second portion of second and third stones.

To be capable of being laid in either a straight runner bond pattern, a reverse runner bond pattern and a herringbone pattern, the multisegment sides of each portion are identical, and each of the multisegment sides of the second portion are complementary with each of the multisegment sides of the first portion, such that, when a multifaced side surface of the first portion of one stone is placed against a multifaced side of another stone in either a straight runner bond pattern, a reverse runner bond pattern or a herringbone pattern, the faces so placed interlock, and drainage areas, each surrounded by interlocking stones, are produced adjacent each stone of the pattern.

In one preferred and illustrated embodiment of the invention, the corner sides are equal in length and the corner surfaces are planar, producing drainage areas that are square. In another embodiment, the corner sides have multiple, and preferably two, segments each, whereby the corner side surfaces are multifaced surfaces producing drainage areas bounded by a multiple of four faces, preferably eight faces.

In other embodiments of the invention, a plurality of stones as set forth above may be combined to produce a single integral stone.

The thickness of the stone is preferably between 0.2 and 0.4 of the maximum horizontal dimension of the stone to produce a stone of desirable strength.

The stone of the present invention provides drainage areas that are surrounded by stones that interlock, producing a stable, load supporting ground cover, and allowing water to drain therethrough. The stones may be laid in a plurality of patterns, including runner bond patterns and the important and superior herringbone pattern, and can be shaped and enhanced, with beveled edges and score lines, to reveal an aesthetic stone shape and ground cover design.

These and other objectives and advantages of the present invention will be more readily apparent from the following detailed description of the drawings in which:

DETAILED DESCRIPTION OF THE DRAWINGS

Figure 1:
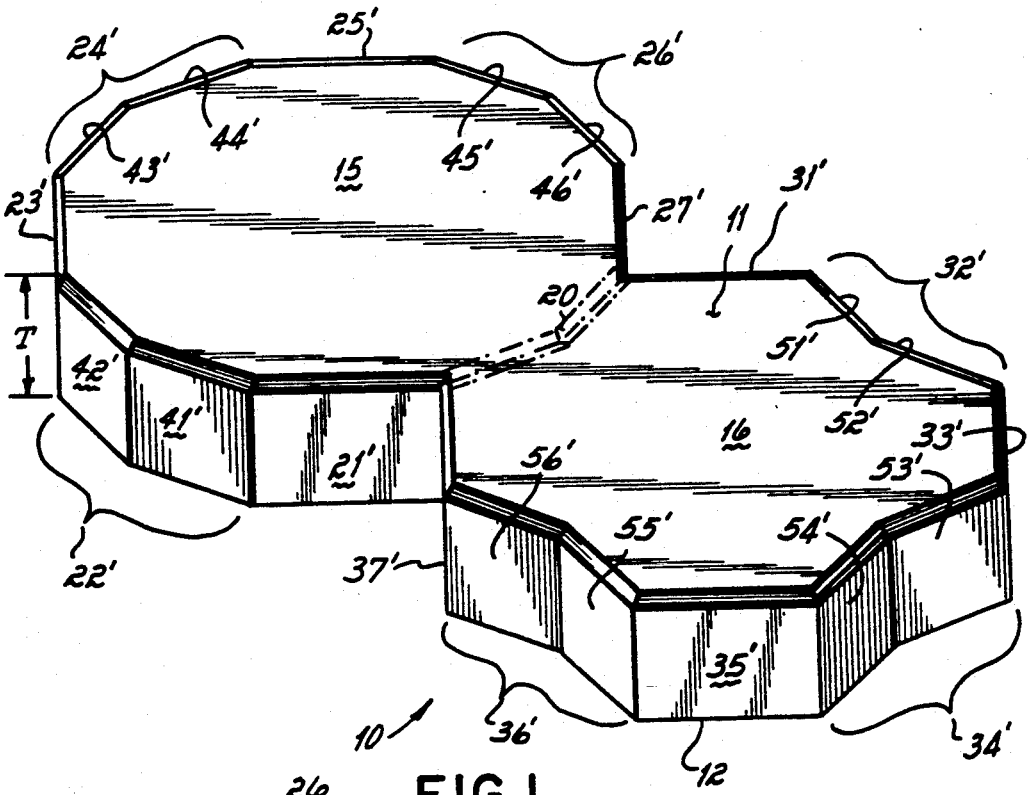
FIG. 1 is a perspective view of a paving stone for covering the ground and the like, according to one embodiment of the present invention.
Figure 2:
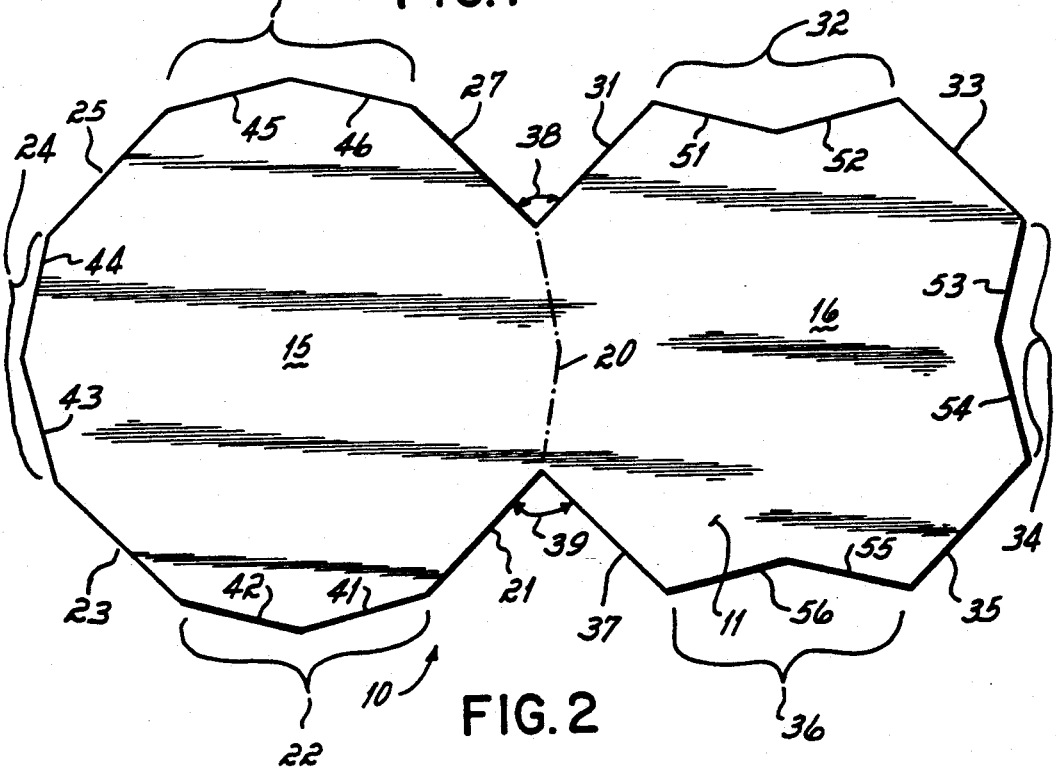
FIG. 2 is a top plan view of the paving stone of FIG. 1.

Referring to FIGS. 1 and 2, a paving stone according to one preferred embodiment of the present invention is illustrated. The stone 10 has a pair of planar top and bottom surfaces 11 and 12 respectively, which are disposed in a generally horizontal orientation when the stones are arranged in a ground cover pattern. The stone 10 has a plurality of side surfaces which are generally vertically oriented and generally perpendicular to the top and bottom surfaces 11 and 12. These side surfaces are preferably either planar or composed of a plurality of planar faces. The arrangement of the side surfaces defines the overall shape of the stone 10, and is responsible for the ascetic appearance of stones 10 when laid in a pattern, the number of types of patterns which the stones will form, the structural properties of the ground cover when the stones are laid in various patterns, and the drainage characteristics of the ground cover patterns formed with the stones 10.

The overall shape of the stones 10 can best be appreciated by regarding the upper and lower surfaces 11 and 12 as made up of two portions, including a convex portion 15 and a concave portion 16. The portions 15 and 16 are polygons in shape, bounded by a plurality of single or multiple segment sides. Each of the sides of the upper and lower surfaces 11 and 12 respectively defines an upper and lower edge of each of the side surfaces of the stone 10, except for sides which the two portions 15 and 16 of each top and bottom surface 11 and 12 have in common.

The sides of each of the portions 15 and 16 include a common side 20, which can be best understood by reference to FIG. 2. The common side 20 is an imaginary side which may therefore be regarded as having any shape, as long as the shape of the common side 20 of the two portions 15 and 16 being complimentary, that is, fully interfitting. As such, the two portions 15 and 16 form an integral surface.

Proceeding clockwise in FIG. 2, the convex portion 15 is bounded in part by the common side 20, a first corner side 21, which makes a wide obtuse angle with a side 20, a first lateral side 22, which is multi-faced in this embodiment and shaped to be interlocking with a side of an adjacent stone, and which in turn forms a wide obtuse angle with the first corner side 21, and a second corner side 23 which also forms wide obtuse angle with the first lateral side 22. Proceeding further, the portion 15 is further bounded by an end side 24, which is also multi-faced and shaped to be interlocking with a side of an adjacent stone, and which also forms a wide obtuse angle with the second corner side 23. The portion 15 is further bounded by a third corner side 25, which forms wide obtuse angles with the end side 24 and with a second lateral side 26, which is also multi-faced and designed to be interlocking with a side of an adjacent stone. A fourth corner side 27 forms wide obtuse angles with the second lateral side 26 and with the common side 20. In the preferred embodiment of the invention, the stone 10, illustrated in FIGS. 1 and 2, has its opposite sides 20 and 24, 21 and 25, 22 and 26, and 23 and 27, generally identical in size and shape and generally parallel.

The concave portion 16, similarly, is bounded by sides which, proceeding clockwise in FIG. 2, include the common side 20, a first corner side 31, which forms a wide obtuse angle with the side 20, and a first lateral side 32, which is multi-faced and shaped to be interlocking with one of the sides 22, 24 or 26 of an adjacent stone, and which also forms wide obtuse angles with the first corner side 31. Similarly, a second corner side 33 forms wide obtuse angles with the first lateral side 32 and with an end side 34. The end side 34 is also a multi-faced side shaped to be interlocking with one of the sides 22, 24 or 26 of an adjacent stone. The side 34 forms a wide obtuse angle with a third corner side 35, which, in turn, forms a wide obtuse angle with a second lateral side 36, which is also multifaced and configured to be interlocking with one of the sides 22, 24 or 26 of an adjacent stone. The side 36 forms a wide obtuse angle with a fourth corner side 37, which, in turn, forms a wide obtuse angle with the common side 20. As with the convex portion 15, the sides of the concave portion 16 that are opposite each other on the surface 11, namely, sides 31 and 35, 32 and 26, 33 and 37, and 34 and 20, are preferably generally parallel to each other and preferably identical in size and shape.

Further, in accordance with the preferred and illustrated embodiment of FIGS. 1 and 2, the first and fourth corner sides of the adjacent portions 15 and 16 of the stone 10, corner sides 27 and 31, and corner sides 21 and 37, are preferably linear and form internal angles 38 and 39 respectively which are preferably approximately 90 degrees. It will be appreciated that the side surfaces corresponding to the corner sides will not, when the stones 10 are laid in a pattern, lie adjacent a side surface of another stone. Therefore, these corner sides need not be linear or any other particular shape, and the corresponding surfaces need not be planar or complimentary with any other side surface of the stone. These corner sides may be curved and the adjacent corner sides may form a continuous curve with each other at their juncture with the common side 20.

In accordance with the present invention, the end surfaces 24 and 34 and the lateral surfaces 22, 26, 32 and 36 are not surfaces lying in a single plane. Each of these surfaces is contoured to interlock with at least one such surface of an opposite portion of an adjacent stone. In the preferred embodiment illustrated in FIGS. 1 and 2, the side 22 includes two equal and generally linear segments 41 and 42, joined at a wide obtuse central angle to form a convex side 22. Similarly, the side 24 is formed of two equal straight segments 43 and 44, also joined at a wide obtuse angle to form a convex side 24. Similarly also, side 26 is formed of a pair of straight equal segments 45 and 46 joined at a wide obtuse central angle to form a convex side 26. In like manner, of the portion 16, the side 32 is formed of a pair of equal straight segments 51 and 52 joined at a wide obtuse central angle but forming a concave side 32. Side 34 is formed of a pair of equal straight segments 53 and 54 also joined at a wide obtuse central angle to form a concave side 34. Similarly, side 36 is formed of a pair of equal straight segments 55 and 56 joined in a wide obtuse central angle to form a concave side 36.

In the preferred embodiment of the invention, the top and bottom surfaces 11 and 12 of the stone 10 are each identical and defined by the shapes of the convex and concave portions 15 and 16 of each. The two surfaces 11 and 12 generally parallel to each other and spaced a distance T which defines the thickness of the stone 10, and the vertical dimension of each of the side surfaces, and faces thereof, of the stone 10. The stone 10 so formed has six multi-faced interlocking side surfaces 22', 24', 26', 32', 34', and 36', each defined by a pair of preferably planar rectangular faces 41' and 42', 43' and 44', 45' and 46', 51' and 52', 53' and 54', and 55' and 56'. The stone 10, so defined, also has eight corner surfaces 21', 23', 25', 27', 31', 33', 35', and 37'. These corner surfaces are, in this embodiment, preferably also rectangular and planar.

The upper edges of the side surfaces and the top surface 11 of the stone 10 may have a beveled edge at the juncture of the side surfaces with the top surface 11 at the sides of the portions 15 and 16 of the top surface 11. A false joint in the form of a V-groove may, accordingly, be provided in the top surface 11 at the juncture of the portion 15 and 16 along what may be defined as the common side 20 thereof to enhance the ascetic appearance of the stone 10 and create the appearance that the convex and concave portions 15 and 16 of the top surface 11 are surfaces of separate stones.

Figure 3:
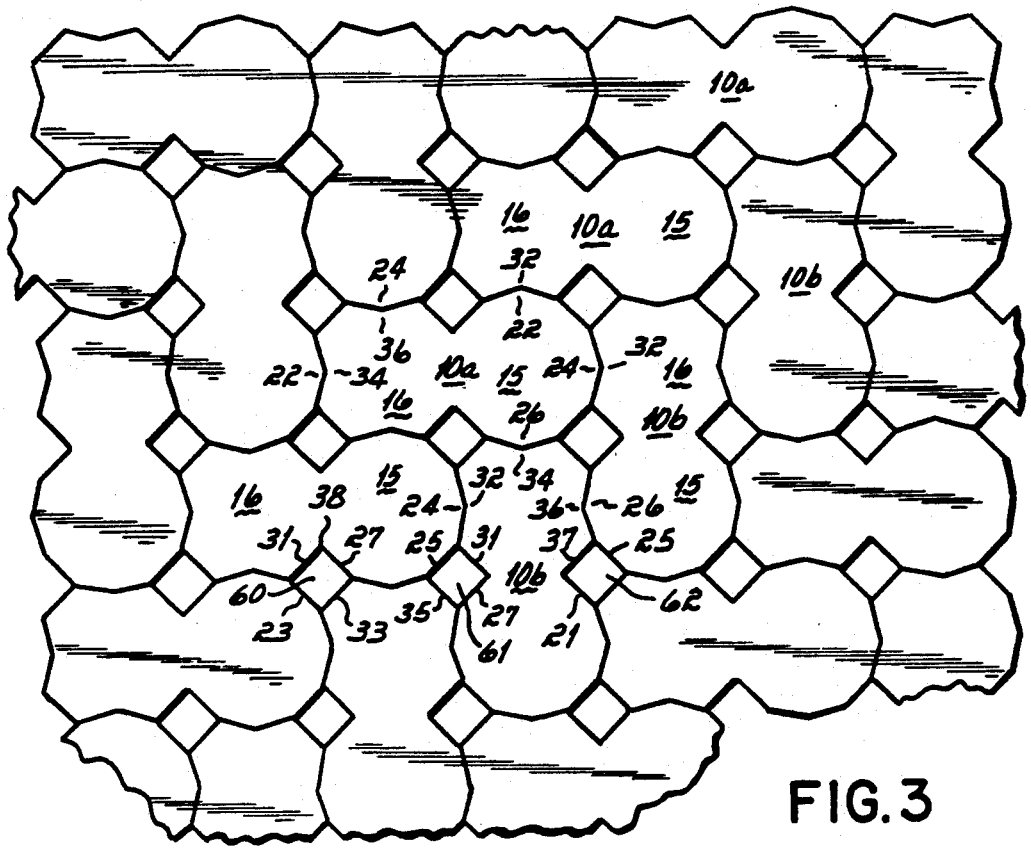
FIG. 3 is a plan view of a ground cover pattern in a herringbone arrangement using the paving stone of FIGS. 1–2.

FIG. 3 illustrates a plurality of the stones 10 laid in a herringbone pattern. The characteristics of the stones 10 that will form this pattern are described with reference to the sides of the portions 15 and 16 of the top surface 11 thereof. In FIG. 3, each of the stones 10 is arranged in either a longitudinal direction, as with the stones 10*a*, or in a transverse direction, as with the stones 10*b*. With each of the stones 10*a*, the end sides 24 of the convex portion 15 of one stone are complimentary with a side 32 of the concave portion 16 of a stone 10*b* so as to interlock therewith. By complimentary is meant that the faces and angles of the surfaces corresponding thereto are identical in size and of opposite orientation when the stones are laid in the pattern.

Similarly, the sides 22 of the convex portions 15 of the stones 10*a* are complimentary with the sides 32 of the concave portions 16 of stones 10*a* to which they are adjacent, and the sides 26 of the convex portions 15 of the stones 10*b* are complimentary with the sides 34 of the concave portions 16 of the stones 10*b*. These sides 22 of the portion 15 of stones 10*b* are complimentary with the sides 34 of the concave portion 16 of the stones 10*a*. Also, the sides 24 of the convex portions 15 of the stone 10*b* are complimentary with the sides 36 of the concave portion 16 of the stones 10*a*. Similarly, the sides 26 of the convex portions 15 of the stones 10*a* are complimentary with the end sides 34 of the concave portions 16 of the stones 10*b*. Furthermore, in order for the stones 10*a* and 10*b* to be totally interchangeable in the laying of the herringbone pattern of FIG. 3, all of the sides, 22, 24, and 26 of the stones 10 should be identical, and each complimentary with the sides 32, 34 or 36 of all of the other stones 10, with the surfaces 32, 34, and 36 thereby also being identical to each other.

In the arrangement of FIG. 3, the corner sides 31 and 27 of the stones 10*a* together with the corner side 33 of the stone 10*b* and the corner side 23 of another stone 10*a*, bound a drainage space or area 60 which is square when these corner sides are planar and inclined at a 90 degree angle 38 with respect to each other. Since, however, these corner surfaces do not lie adjacent a surface of an adjacent stone, they need not be planar or even parallel. Similarly, the surface corresponding to side 25 of the stone 10*a*, forms, in cooperation with surfaces 31 and 27 of an adjacent stone 10*b*, and the corner surface 35 of another stone 10*b* a further drainage area 61 which is preferably identical to the drainage area 60. Similarly, the side 25 of a stone 10*b* forms in cooperation with side 35 of a stone 10*a* and sides 21 and 37 of another stone 10*b* a drainage area 62, which is preferably identical to the drainage areas 60 and 61. Preferably, all of the corner sides of the stones 10 are identical and preferably straight, forming angles of about 45 degrees with the center line extending through the end faces of the stones 10.

Figure 4:
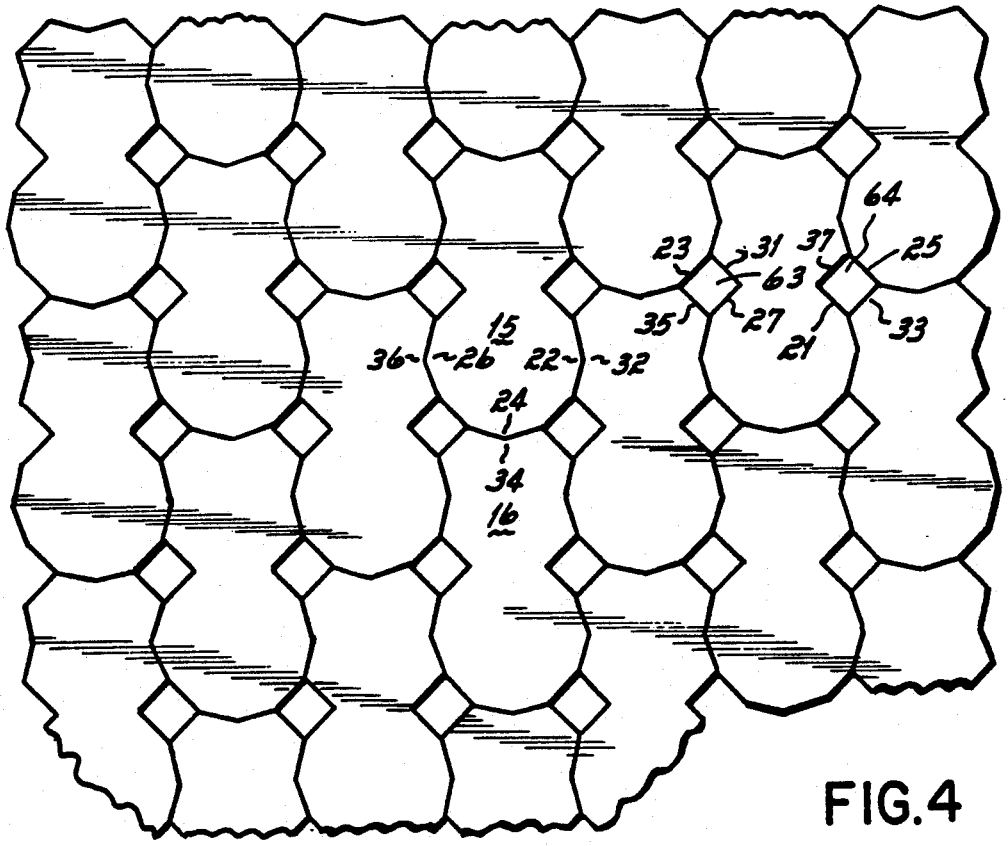
FIG. 4 is a plan view similar to FIG. 3 illustrating the same paving stone of FIGS. 1–2 laid in a straight runner bond arrangement.

Referring to FIG. 4, the stones 10 laid in a straight runner bond pattern are illustrated. With this pattern, it is necessary that the end side 24 of the convex portion 15 of the stones 10 be complimentary with the end side 34 of the convex portion 16 of adjacent stones 10, that the side 22 to be complimentary with the side 32 and side 26 be complimentary with the side 36 of adjacent stones. In this arrangement, corner sides 27 and 31 of one stone will, in cooperation with a corner side 35 of another stone and with corner side 23 of yet another stone, form a drainage area 63. Similarly, corner sides 21 and 37 will, in cooperation with a corner side 25 of another stone and a corner side 33 of another stone, form a drainage area 64. While it is not necessary, to form this straight runner bond pattern, that other sides being identical and complimentary, it is preferred in order that the stones be also capable of forming the herringbone pattern of FIG. 3.

Figure 5:
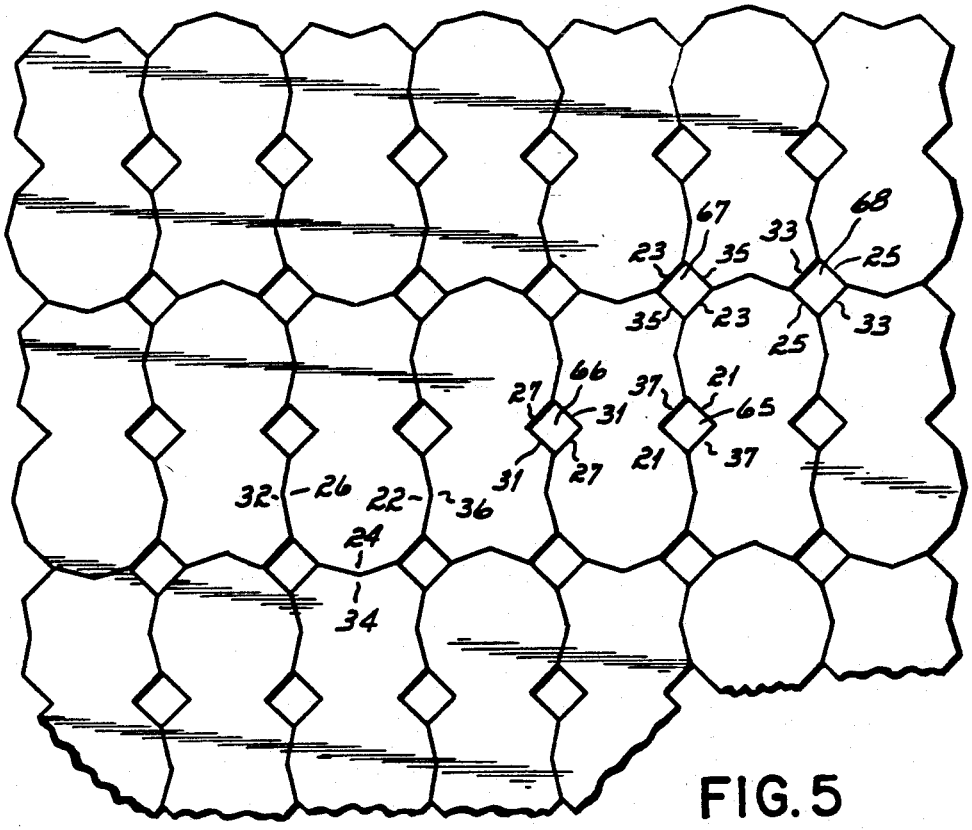
FIG. 5 is a plan view similar to FIG. 4 illustrating the same paving stone of FIGS. 1-2 laid in a reverse runner bond arrangement.

FIG. 5 illustrates the stones 10 laid in a reverse runner bond pattern. For the stones 10 to be capable of being laid in this pattern, side 22 of the portion 15 is complimentary with the side 36 of the portion 16 of the stones 10, the end side 24 of the portion 15 is complimentary with the end side 34 of the portion 16, and the side 26 of the portion 15 is complimentary with the side 32 of the portion 16. As with the pattern illustrated in FIG. 4, in order to be capable of being laid in the straight runner bond pattern of FIG. 4, as well as the reverse runner bond pattern of FIG. 5, the sides 22 and 26 of the portion 15 should be equal and complimentary with the sides 32 and 36 of the portion 16, which should in turn be identical.

In the reverse runner bond pattern of FIG. 5, drainage areas 65 are bounded by corner sides 21 and 37 of adjacent stones 10 and drainage areas 66 are bounded by corner sides 27 and 31 of adjacent stones 10. Further, drainage areas 67 are bounded by corner sides 23 and 35 respectively of an adjacent pair of stones and by the sides 23 and 35 respectively of the stones of another adjacent pair of stones which are in turn adjacent to the stones of the first pair. Similarly, corners sides 25 and 23 of adjacent stones bound the drainage area 68, which is also bounded by sides 25 and 33 respectively of another pair of adjacent stones which is adjacent the first pair of adjacent stones.

Figure 6:
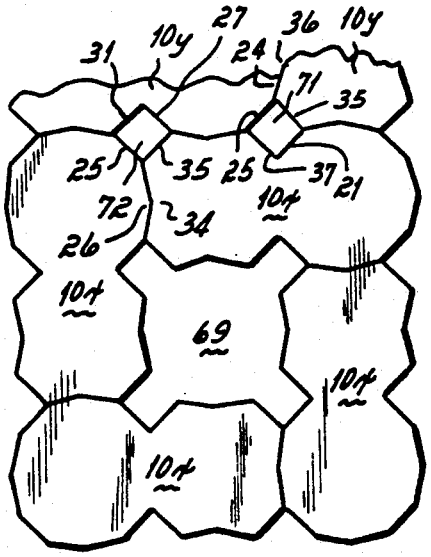
FIG. 6 is a plan view illustrating the same paving stone of FIGS. 1-2 laid in another pattern.

In FIG. 6 it is illustrated that the stones 10 can be laid in other patterns. In the pattern illustrated, a set of four stones 10*x* are arranged in a square with the sides 26 of the convex portions of each adjacent and complimentary with the end sides 34 of the concave portions of each thereby defining a drainage area 69 which they surround. When placed against identical blocks of stones 10*y*, arranged in a reverse rotation in a similar square, with the convex end sides 24 of each complimentary with an adjacent to the sides 36 of each, additional drainage spaces 71 and 72 are formed therebetween, with the sides of 35 of stone 10*y* and side 25 of another stone 10y cooperating with the sides 21 and 37 of the stone 10x to form the drainage space 71, and the sides 27 and 31 of the stone 10y cooperating with the sides 35 of one stone 10x and the side 25 of another stone 10x to bound the drainage space 72.

Figure 7:
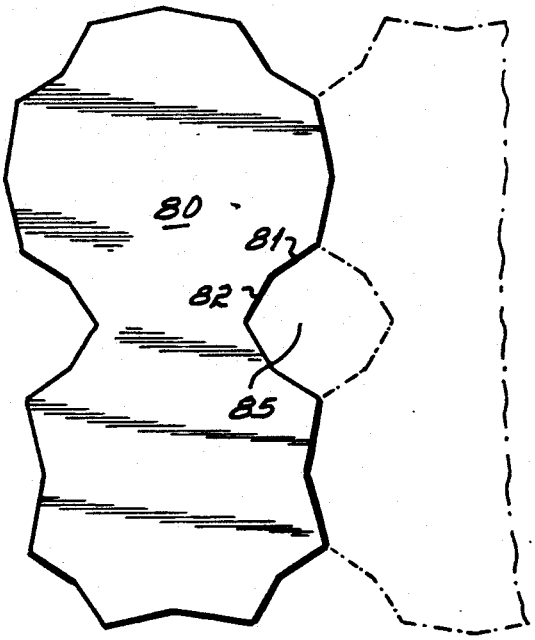
FIG. 7 is a plan view of a paving stone according to an alternative embodiment of the invention.

FIG. 7 illustrates an alternative embodiment 80 of the stones in which each of the corner sides of the stone 80 are formed of two equal straight segments 81 and 82 such that the corner surfaces are multifaced and surround an octagonal drainage area 85 when the stones 80 are laid in the pattern such as those of FIGS. 3–5 above.

While the preferred embodiments of the invention are described in detail above, it will be apparent to those skilled in the art that modifications and variations of the paving stone may be made without departing from the principles of the present invention.

Accordingly, what is claimed is:

1. An interlocking paving stone capable of being laid in a plurality of open patterns, including a straight runner bond pattern, a reverse runner bond pattern and a herringbone pattern, the stone comprising:

an integral block of molded ceramic material having a generally horizontal upper surface, a generally identical and generally parallel lower surface spaced from the upper surface a distance defining the thickness of the stone, six generally vertical multifaced interlocking side surfaces, and eight generally vertical corner surfaces;

the horizontal surfaces each being a two portion horizontal surface defined by a first portion and a second portion;

each of the portions of the horizontal surfaces having eight sides, including a common side and alternating corner sides and multisegment sides;

each of the portions of the horizontal surfaces being joined together at their common sides to define an integral two portion stone having fourteen side surfaces, including the six multifaced side surfaces and the eight corner surfaces each having an upper and lower edge bounded by corresponding sides of corresponding portions of the upper and lower surfaces; and the multisegment sides of each portion being identical, and each of the multisegment sides of the second portion being complementary with each of the multisegment sides of the first portion, such that, when a multifaced side surface of the first portion of one stone is placed against a multifaced side of another stone in either a straight runner bond pattern, a reverse runner bond pattern or a herringbone pattern, the faces so placed interlock, and drainage areas, each surrounded by corner surfaces of interlocking stones, are produced adjacent each stone of the pattern.

2. The paving stone of claim 1 wherein:

the corner sides are equal in length and the corner surfaces are planar, whereby each drainage area so produced is square.

3. The paving stone of claim 1 wherein:

the corner sides are multisegment sides, whereby the corner side surfaces are multifaced surfaces, whereby each drainage area so produced is bounded by a multiple of four faces.

4. The paving stone of claim 3 wherein:

the corner sides are multisegment sides each having two straight segments, whereby the corner side surfaces each have two planar faces, whereby each drainage area so produced is bounded by eight planar faces.

5. The paving stone of claim 4 wherein:

the multifaced side surfaces each have two planar faces.

6. The paving stone of claim 1 wherein:

the multifaced side surfaces each have two planar faces.

7. An interlocking paving stone capable of being laid in an open runner bond pattern, the stone comprising:

an integral block of molded ceramic material having a generally horizontal upper surface, a generally identical and generally parallel lower surface spaced from the upper surface a distance defining the thickness of the stone, six generally vertical multifaced interlocking side surfaces, and eight generally vertical corner surfaces;

the horizontal surfaces each being a two portion horizontal surface defined by a first portion and a second portion;

each of the portions of the horizontal surfaces having eight sides, including a common side and alternating corner sides and multisegment, including, in order in the same direction around each of the portions, the common side, a first corner side, a first multisegment lateral side, a second corner side, a multisegment end side, a third corner side, a second multisegment lateral side, and a fourth corner side;

each of the portions of the horizontal sides being joined together at their common sides to define an integral two portion stone having fourteen side surfaces, including the six multifaced side surfaces and the eight corner surfaces each having an upper and lower edge bounded by corresponding sides of corresponding portions of the upper and lower surfaces; and the end sides of each portion being complementary, and each of the lateral sides of the first portion being complementary to a different one of the lateral sides of the second portion, such that, when a plurality of stones are arranged in a runner bond pattern, the surface corresponding to the end side of the first portion of a first stone interlocks with the surface corresponding to the end side of the second portion of a second stone, while the surfaces corresponding to the lateral sides of the first portion of the first stone each interlock with a surface corresponding to a lateral side of the second portion of respective second and third stones, and drainage areas, each surrounded by corner surfaces of different interlocking stones, are produced adjacent each stone of the pattern.

8. The paving stone of claim 7 capable of being laid in an open straight runner bond pattern, wherein:

the first and second lateral sides of the first portion are complementary to a respective first and second lateral sides of the second portion, such that, when a plurality of stones are arranged in a straight runner bond pattern, the surfaces corresponding to the first: and second lateral sides of the first portion of the first stone each interlock with the surfaces corresponding to respective first and second lateral sides of the second portion of respective second and third stones.

9. The paving stone of claim 7 capable of being laid in an open reverse runner bond pattern, wherein:

the first and second lateral sides of the first portion are complementary to a respective second and first lateral sides of the second portion, such that, when a plurality of stones are arranged in a reverse runner bond pattern, the surfaces corresponding to the first and second lateral sides of the first portion of the first stone each interlock with the surfaces corresponding to respective second and first lateral sides of the second portion of respective second and third stones.

10. The paving stone of claim 7 capable of being laid in a plurality of open patterns including a straight runner bond pattern or a reverse runner bond pattern, wherein:

the lateral sides of the first portion are each complementary to lateral sides of the second portion, such that, when a plurality of stones are arranged in either a straight runner bond pattern or a reverse runner bond pattern, the surfaces corresponding to the lateral sides of the first portion of the first stone each interlock with a surface corresponding to a lateral side of the second portion of second and third stones.

11. The paving stone of claim 7 wherein:

the corner sides are equal in length and the corner surfaces are planar, whereby each drainage area so produced is square.

12. The paving stone of claim 7 wherein:

the corner sides are multisegment sides, whereby the corner side surfaces are multifaced surfaces, whereby each drainage area so produced is bounded by a multiple of four faces.

13. The paving stone of claim 12 wherein:

the corner sides are multisegment sides each having two straight segments, whereby the corner side surfaces each have two planar faces, whereby each drainage area so produced is bounded by eight planar faces.

14. The paving stone of claim 13 wherein:

the multifaced side surfaces each have two planar faces.

15. The paving stone of claim 7 wherein:

the multifaced side surfaces each have two planar faces.

16. An interlocking paving stone capable of being laid in an open pattern, the stone comprising:

an integral block of molded ceramic material having a generally horizontal upper surface, a generally identical and generally parallel lower surface spaced from the upper surface a distance defining the thickness of the stone, six generally vertical multifaced interlocking side surfaces, and eight generally vertical corner surfaces;

the horizontal surfaces each being a two portion horizontal surface defined by a first portion and a second portion;

each of the portions of the horizontal surfaces having eight sides, including a common side and alternating corner sides and multisegment sides, including, in order in the same direction around each of the portions, the common side, a first corner side, a first multisegment side, a second corner side, a second multisegment side, a third corner side, a third multisegment side, and a fourth corner side;

each of the portions of the horizontal sides being joined together at their common sides to define an integral two portion stone having fourteen side surfaces, including the six multifaced side surfaces and the eight corner surfaces each having an upper and lower edge bounded by corresponding sides of corresponding portions of the upper and lower surfaces; and at least one of the multisegment sides of the first portion being complementary to at least one of the multisegment sides of the second portion such that, when a plurality of stones are arranged in a pattern, a surface corresponding to the multisegment side of the first portion of a first stone interlock with a surface corresponding to a multisegment side of the second portion of an adjacent stone, and drainage areas are produced adjacent a corner surface of each stone of the pattern.

17. The paving stone of claim 16 wherein:

the corner sides are equal in length and the corner surfaces are planar, whereby each drainage area so produced is square.

18. The paving stone of claim 16 wherein:

the corner sides are multisegment sides, whereby the corner side surfaces are multifaced surfaces, whereby each drainage area so produced is bounded by a multiple of four faces.

19. The paving stone of claim 16 wherein:

the corner sides are multisegment sides each having two straight segments, whereby the corner side surfaces each have two planar faces, whereby each drainage area so produced is bounded by eight planar faces.

20. The paving stone of claim 16 wherein:

the multifaced side surfaces each have two planar faces.

* * * * *